US010714286B2

(12) United States Patent
Johnson

(10) Patent No.: US 10,714,286 B2
(45) Date of Patent: Jul. 14, 2020

(54) MAGNETICALLY ACTIVATED SWITCH HAVING MAGNETOSTRICTIVE MATERIAL

(71) Applicant: Littelfuse, Inc., Chicago, IL (US)

(72) Inventor: Brian Johnson, Cornwall (GB)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/989,721

(22) Filed: May 25, 2018

(65) Prior Publication Data

US 2019/0362920 A1 Nov. 28, 2019

(51) Int. Cl.
*H01H 36/00* (2006.01)
*H01H 37/58* (2006.01)

(52) U.S. Cl.
CPC ..... *H01H 36/00* (2013.01); *H01H 37/58* (2013.01); *H01H 2036/0093* (2013.01)

(58) Field of Classification Search
CPC ... H01F 35/147; H01F 36/00–36/0066; H01H 35/147; H01H 36/00–36/0066; H01H 37/00–2037/769
See application file for complete search history.

(56) References Cited

U.S. PATENT DOCUMENTS 2,764,647 A 9/1956 Leslie et al.
2,798,213 A 7/1957 Rowell
2,896,044 A * 7/1959 McCreary ..... H01H 55/00 335/3
2,897,312 A 7/1959 Ziegler, Jr.
2006/0238281 A1* 10/2006 Steinberg ..... H01H 36/0013 335/207
2011/0213445 A1 9/2011 Blischak

FOREIGN PATENT DOCUMENTS

CN 1624846 A * 6/2005
JP 54127826 A * 10/1979
JP 2015046310 A2 3/2015

OTHER PUBLICATIONS

Wikipedia, Permalloy.*
International Search Report and Written Opinion for the International Patent Application No. PCT/US19/33451, dated Aug. 9, 2019, 9 pages.

* cited by examiner

*Primary Examiner* — Ramon M Barrera

(57) ABSTRACT

Switch assemblies and a switching method are disclosed. In some embodiments, a switch assembly may include a first contact element, and a second contact element operable with the first contact element. The first and second contact elements form an open circuit in a first configuration and form a closed circuit in a second configuration. At least one of the first contact element and the second contact element includes a magnetostrictive material. During operation, a magnetic field from a magnet causes the magnetostrictive material to deform or change shape/dimensions, thus causing the first and second contact elements to open or close. In some embodiments, the switch assembly is a micro-electro-mechanical-system (MEMS) switch.

15 Claims, 4 Drawing Sheets

MAGNETICALLY ACTIVATED SWITCH HAVING MAGNETOSTRICTIVE MATERIAL

BACKGROUND OF THE DISCLOSURE

Field of the Disclosure

This disclosure relates generally to the field of switches and, more particularly, to magnetically activated switches having magnetostrictive material.

Discussion of Related Art

A number of different types of magnetic proximity switches utilizing reed switches or similar contact configurations for actuation in response to a magnetic field are presently known. Early types of magnetic switches consist of a pair of contacts formed of magnetic material and physically disposed relative to a magnet to achieve a desired switch position. More specifically, reed switches are operated by the magnetic field of an energized coil or a permanent magnet, which induces north (N) and south (S) poles on the reeds. The reed contacts are closed/opened by this magnetic attractive force. When the magnetic field is removed, the reed elasticity causes the contacts to open/close the circuit.

One of the key parameters of a switch is the contact resistance when the switch is closed, which may be around 10 mOhms. The contact resistance is directly related to the contact pressure of the contacts. In reed switches, this contact pressure may be on the order of 20 centinewtons when the dimensions of the reed are reduced to a few micro-meter thickness, which is required for Micro-Electro-Mechanical Systems (MEMS) fabrication. However, with conventional reed switches, there is not enough magnetic material to sustain a large enough magnetic field to generate sufficient contact force to give a low contact resistance.

It is with respect to at least this deficiency that the present disclosure is provided.

SUMMARY OF THE DISCLOSURE

In one or more embodiments, a switch assembly may include a first contact element operable with a second contact element to form an open circuit or a closed circuit. The switch assembly may further include a magnetostrictive element coupled to at least one of the first contact element and the second contact element, the magnetostrictive element operable to bias the first contact element and the second contact element relative to one another to form the open circuit or the closed circuit.

In one or more embodiments, a switching method may include providing a first contact element operable with a second contact element, wherein the first and second contact member form an open circuit in a first configuration and form a closed circuit in a second configuration, and wherein at least one of the first contact element and the second contact element includes a magnetostrictive element. The switching method may further include biasing the first contact element and the second contact element relative to one another using a magnetic field to change the shape the magnetostrictive element.

In one or more embodiments, a micro-electro-mechanical systems (MEMS) switch assembly may include a first contact element, a second contact element operable with the first contact element. The first and second contact members may form an open circuit in a first configuration, and form a closed circuit in a second configuration, wherein the first contact element includes a magnetostrictive material.

BRIEF DESCRIPTION OF THE DRAWINGS

The accompanying drawings illustrate exemplary approaches of the disclosed switch assemblies so far devised for the practical application of the principles thereof, and in which.

Figure 1A:
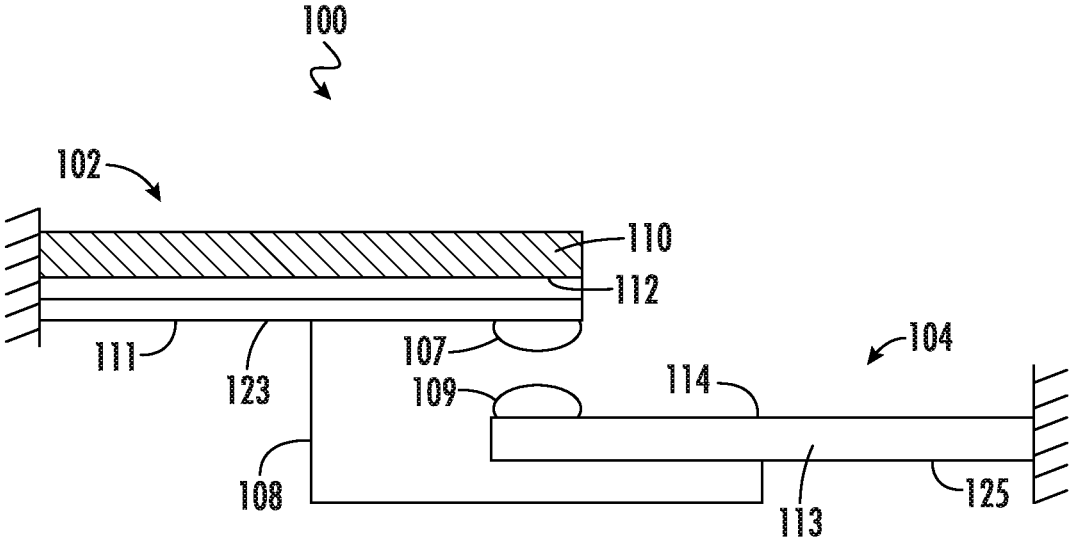
FIG. 1A is a side view of a switch assembly in a first configuration according to exemplary embodiments of the disclosure.

The drawings are not necessarily to scale. The drawings are merely representations, not intended to portray specific parameters of the disclosure. Furthermore, the drawings are intended to depict exemplary embodiments of the disclosure, and therefore is not considered as limiting in scope.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

The present disclosure will now proceed with reference to the accompanying drawings, in which various approaches are shown. It will be appreciated, however, that the switch assembly may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

As used herein, an element or operation recited in the singular and proceeded with the word "a" or "an" should be understood as not excluding plural elements or operations, unless such exclusion is explicitly recited. Furthermore, references to "one approach" or "one embodiment" of the present disclosure are not intended to be interpreted as excluding the existence of additional approaches and embodiments that also incorporate the recited features.

Furthermore, spatially relative terms, such as "beneath," "below," "lower," "central," "above," "upper," "proximal," "distal," and the like, may be used herein for ease of describing one element's relationship to another element(s)

as illustrated in the figures. It will be understood that the spatially relative terms may encompass different orientations of the device in use or operation in addition to the orientation depicted in the figures.

As disclosed, embodiments herein provide switch assemblies and switching methods. In some embodiments, a switch assembly may include a first contact element, and a second contact element operable with the first contact element, wherein the first and second contact members form an open circuit in a first configuration and form a closed circuit in a second configuration. At least one of the first contact element and the second contact element includes a magnetostrictive material. In some embodiments, the switch assembly further include a magnet proximate the first and second contact elements, wherein a magnetic field of the magnet causes the magnetostrictive material to deform or change shape/dimensions.

Employing a magnetostrictive activated switch may advantageously reduce the cost of switches, e.g., for use is MEMS. Unlike conventional reed switches, which are unable to sustain a large enough magnetic field to generate sufficient contact force to give a low contact resistance, the magnetostrictive effect from the magnetostrictive activated switch can generate much higher forces than magnetic attraction. The magnetostrictive activated switch therefore improves activation, for example, when manufactured using MEMS techniques.

In various embodiments, a MEMS magnetostrictive switching device may include two flexible, cantilevered members that are deflected in the presence of a magnetic field. One or more of the cantilevered members may include a magnetostrictive material. When a magnetic field is applied in the proper orientation, the magnetostrictive material may expand. As one or both of the cantilevered members deflect, contact is made with one another, closing a circuit electrically. In other embodiments, the MEMS magnetostrictive switching device may be configured in a normally closed architecture, such that the switch opens rather than closes on application of a magnetic field.

Figure 1B:
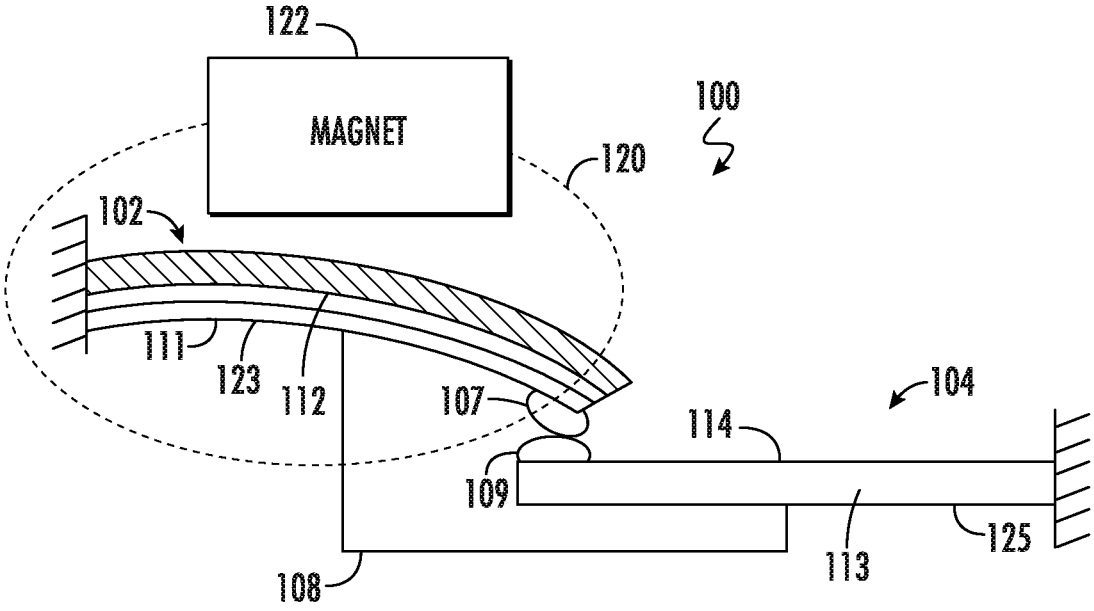
FIG. 1B is a side view of the switch assembly of FIG. 1A in a second configuration according to exemplary embodiments of the disclosure.

Referring now to FIGS. 1A-1B, a switch assembly (hereinafter "assembly") 100 according to embodiments of the disclosure will be described. As shown, the assembly 100 may include a first contact element 102 operable with a second contact element 104 to form an open or closed circuit via a switching circuit 108. The switching circuit 108 may receive and/or communicate an indication of the open circuit or the closed circuit. In exemplary embodiments, the first and second contact elements 102, 104 are each electrically conductive, and include contact tips 107 and 109, respectively, to make an electrical connection therebetween. One or both of the first and second contact elements 102, 104 may be a spring-like element providing the necessary robustness and elasticity for making/breaking contact between the first and second contact elements 102, 104.

In some embodiments, a magnetostrictive element 110 may be coupled to a bi-metallic strip 111 of the first contact element 102 and/or the second contact element 104. For example, as shown, the magnetostrictive element 110 may be directly physically coupled to an outer side 112 of the bi-metallic strip 111 of the first contact element 102. The magnetostrictive element 110 may also be coupled to an inner side 123 of the bi-metallic strip 111 of the first contact element 102. In other embodiments, the first contact element 102 may be made partially or entirely from a magnetostrictive material. In yet other embodiments, another magnetostrictive element (not shown), may be coupled to an inner surface 114 and/or an outer surface 125 of a bi-metallic strip 113 of the second contact element 104.

As used herein, magnetostriction is a phenomenon observed in ferromagnetic materials. Magnetostriction is a combination of elastic, electric, magnetic and, in some situations, thermal fields. Magnetostrictive materials, which make up the magnetostrictive element 110, are solids that develop large mechanical deformations when subjected to an external magnetic field. This phenomenon is attributed to the rotations of small magnetic domains in the material, which are randomly oriented when the material is not exposed to a magnetic field. The orientation of these small domains by the imposition of the magnetic field creates a strain field. As the intensity of the magnetic field is increased, more and more magnetic domains orientate themselves so that their principal axes of anisotropy are collinear with the magnetic field in each region and finally saturation is achieved, thus causing mechanical deformation, such as elongation.

FIG. 1A demonstrates the switch assembly 100 in a first configuration (e.g., open), while FIG. 1B demonstrates the switch assembly 100 in a second configuration (e.g., closed). In exemplary embodiments, the presence of a magnetic field 120 of a magnet 122 causes the magnetostrictive element 110 to change configuration (e.g., shape and/or dimensions), thus causing the first contact element 102 to move towards the second contact element 104. For example, in the case one of the contact elements 102, 104 may be made from a bi-metal strip, and the other of the contact elements 102, 104 is a magnetostrictive material, the magnetostrictive material will expand, thus causing that contact element to bend under the influence of the magnetic field 120. This combination can be made quasi bi-stable so that in the presence of the magnetic field 120, the set of contact elements 102, 104 open or close. As shown, the set of contact elements 102, 104 may each have cantilevered free ends proximate respective contact tips 107 and 109, and fixed ends. The fixed ends resist movement, thereby causing the cantilevered free end(s) to bend in response to the magnetic field 120.

In non-limiting embodiments, the switch assembly 100 is normally open. In other embodiments, the switch assembly 100 may be normally closed, and opens in response to the magnet 122 proximate thereto. The magnet 122 may travel past the first and second contact elements 102, 104 to activate the switch.

Figure 2A:
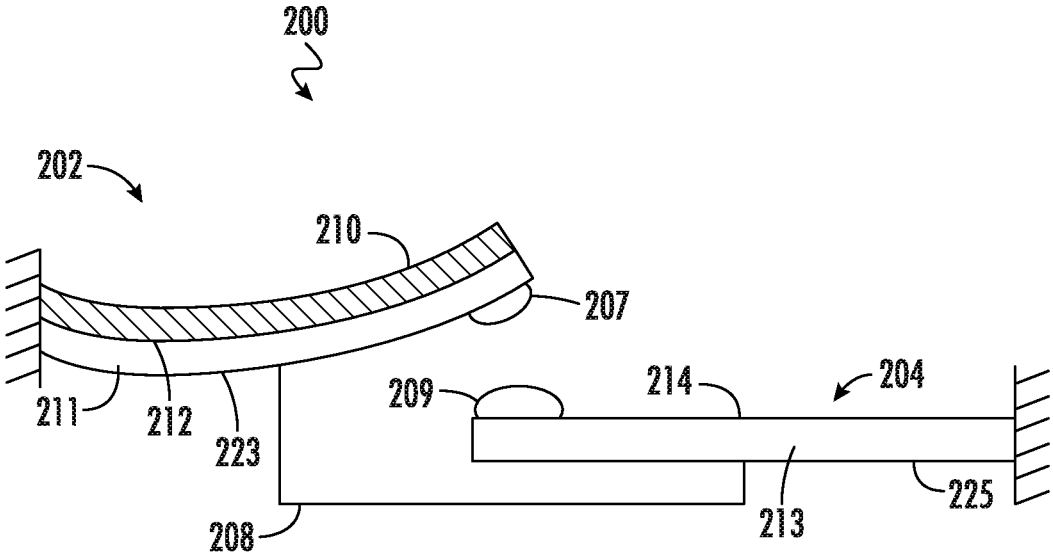
FIG. 2A is a side view of a switch assembly in a first configuration according to exemplary embodiments of the disclosure.
Figure 2B:
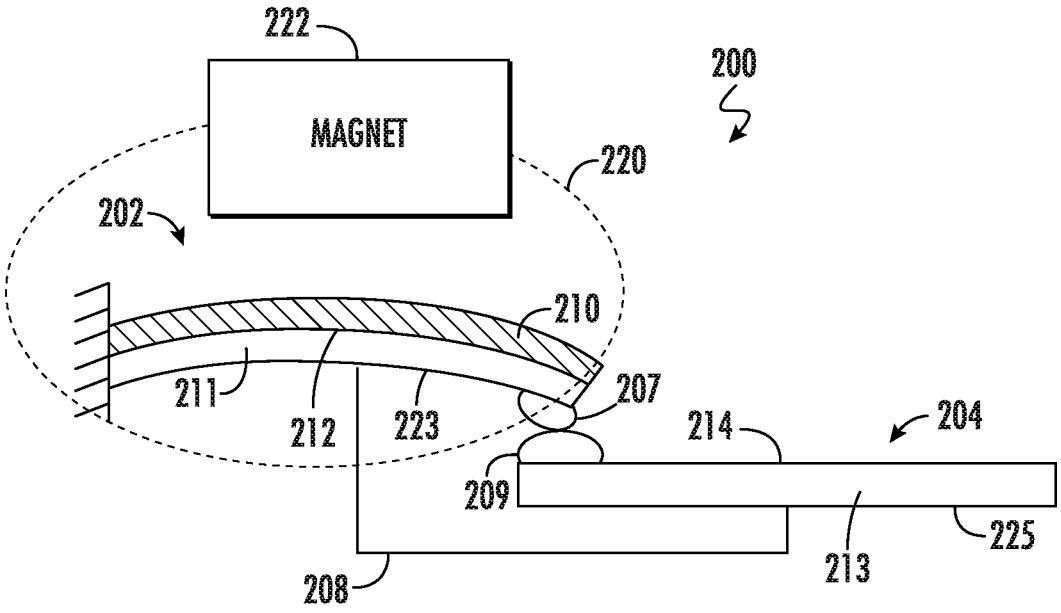
FIG. 2B is a side view of the switch assembly of FIG. 2A in a second configuration according to exemplary embodiments of the disclosure.

Referring now to FIGS. 2A-2B, a switch assembly (hereinafter "assembly") 200 according to embodiments of the disclosure will be described. As shown, the assembly 200 may include a first contact element 202 operable with a second contact element 204 to form an open or closed circuit via a switching circuit 208. In exemplary embodiments, the first and second contact elements 202, 204 are each electrically conductive, and include contact tips 207 and 209, respectively, to make an electrical connection therebetween. In some embodiments, a magnetostrictive element 210 may be coupled to a bi-metallic strip 211 of the first contact element 202 and/or the second contact element 204. For example, as shown, the magnetostrictive element 210 may be directly physically coupled to an outer side 212 of the bi-metallic strip 211 of the first contact element 202. The magnetostrictive element 210 may also be coupled to an inner side 223 of the bi-metallic strip 211 of the first contact element 202. In other embodiments, the first contact element 202 may be made partially or entirely from a magnetostrictive material. In yet other embodiments, another magnetostrictive element (not shown), may be coupled to an inner surface 214 and/or an outer surface 225 of a bi-metallic strip 213 of the second contact element 204.

FIG. 2A demonstrates the switch assembly 200 in a first configuration (e.g., open), while FIG. 2B demonstrates the switch assembly 200 in a second configuration (e.g., closed). In exemplary embodiments, the presence of a magnetic field 220 of a magnet 222 causes the magnetostrictive element 210 to change shape, thus causing the first contact element 202 to move towards the second contact element 204. For example, in the case one of the contact elements 202, 204 may be made from a bi-metal strip, and the other of the contact elements 202, 204 is a magnetostrictive material, the magnetostrictive material will bend under the influence of the magnetic field 220. This combination can be made quasi bi-stable so that in the presence of the magnetic field 220, the set of contact elements 202, 204 open or close. In non-limiting embodiments, the switch assembly 200 is normally open. In other embodiments, the switch assembly 200 may be normally closed, and opens in response to the magnet 222 proximate thereto.

In the non-limiting embodiment shown, at least one of the first contact element 202 and the second contact element 204 has a curved shape. The first contact element 202 may curve/bend away from the second contact 204 in the first configuration shown in FIG. 2A, and may curve/bend towards the second contact 204 in the second configuration shown in FIG. 2B. The expansion of the magnetostrictive element 210 in response to the magnetic field 220 causes the first contact element 202 to change from a generally convex shape to a generally concave shape.

Figure 3:
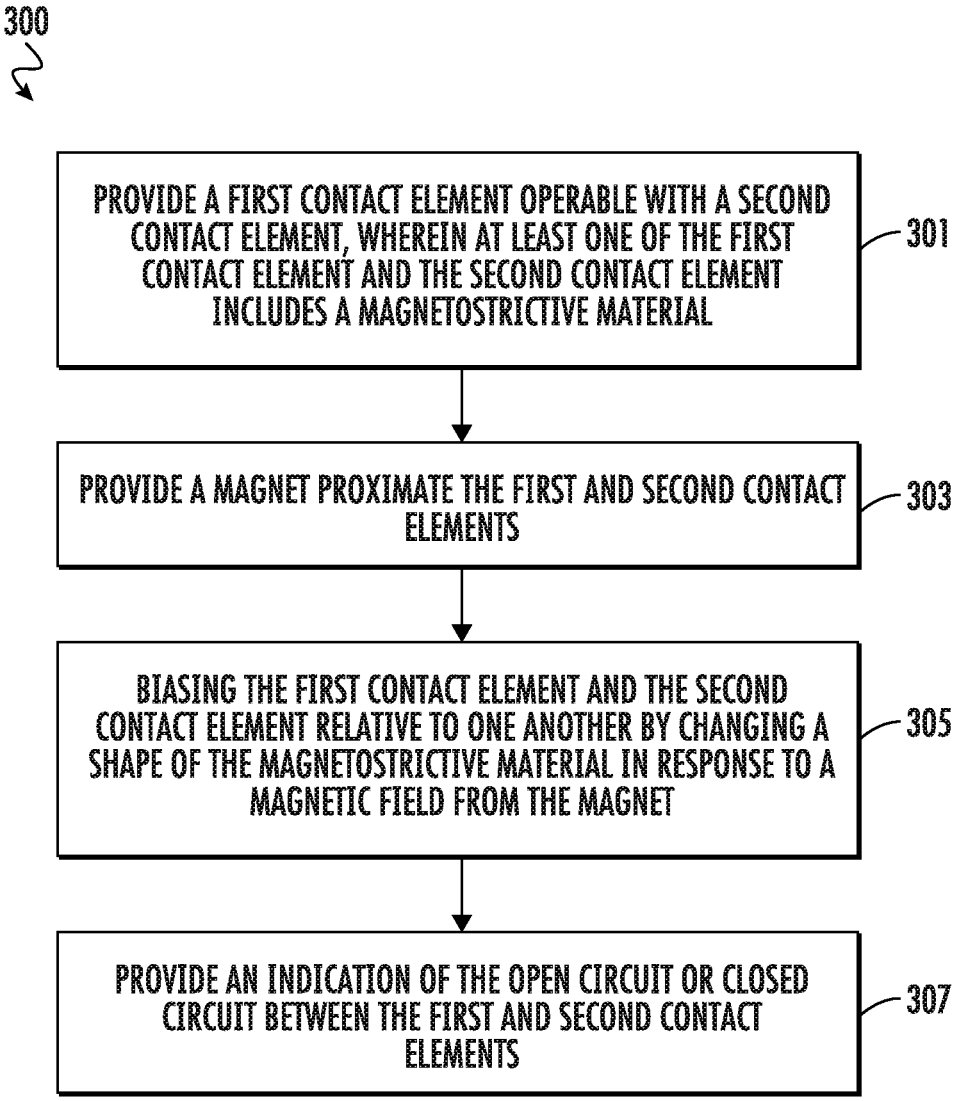
FIG. 3 is a process flow for operating a switch having a magnetostrictive material according to exemplary embodiments of the disclosure.

Turning now to FIG. 3, a method 300 for operating the switch assembly 100 and/or the switch assembly 200 according to embodiments of the present disclosure will be described in greater detail. At block 301, the method 300 may include providing a first contact element operable with a second contact element, wherein at least one of the first contact element and the second contact element includes a magnetostrictive material. The first and second contact elements may form an open circuit in a first configuration, and form a closed circuit in a second configuration. In some embodiments, the magnetostrictive element is directly physically coupled to the contact element and/or the second contact element. In some embodiments, the first contact element has a curved shape. In some embodiments, the first contact element curves away from the second contact element in the first configuration, and curves towards the second contact element in the second configuration.

At block 303, the method 300 may include providing a magnet proximate the first and second contact elements. At block 305, the method may include biasing the first contact element and the second contact element relative to one another by changing a shape or configuration of the magnetostrictive element in response to a magnetic field from the magnet. In some embodiments, the change in shape of the magnetostrictive element causes an open circuit or a closed circuit of a switching circuit electrically connected with the first contact element and the second contact element.

At block 307, the method 300 may include providing an indication of the open circuit or closed circuit between the first and second contact elements.

Figure 4A:
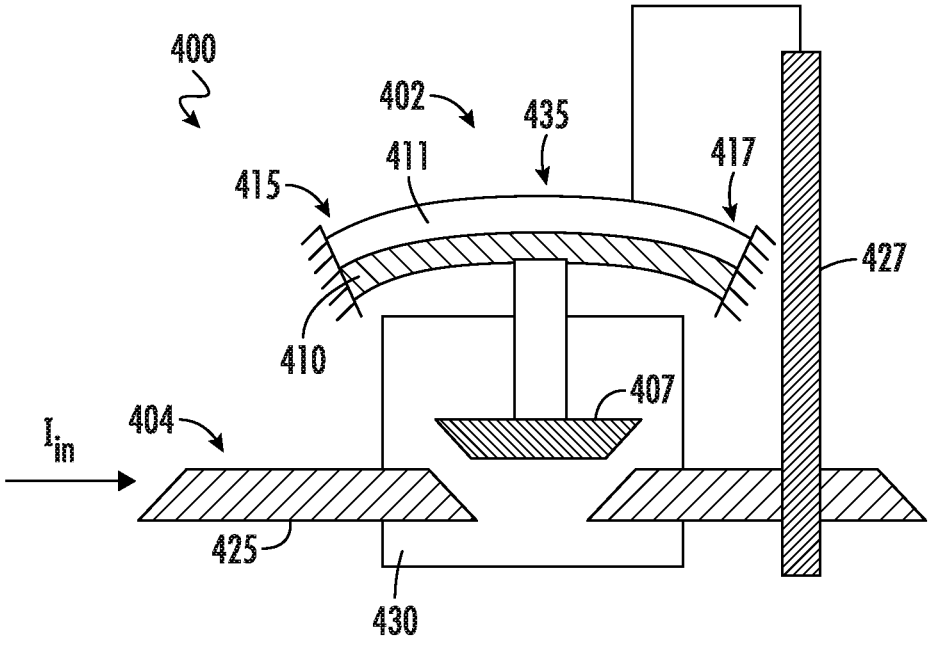
FIG. 4A is a side view of a MEMS switch assembly in an open configuration according to exemplary embodiments of the disclosure.
Figure 4B:
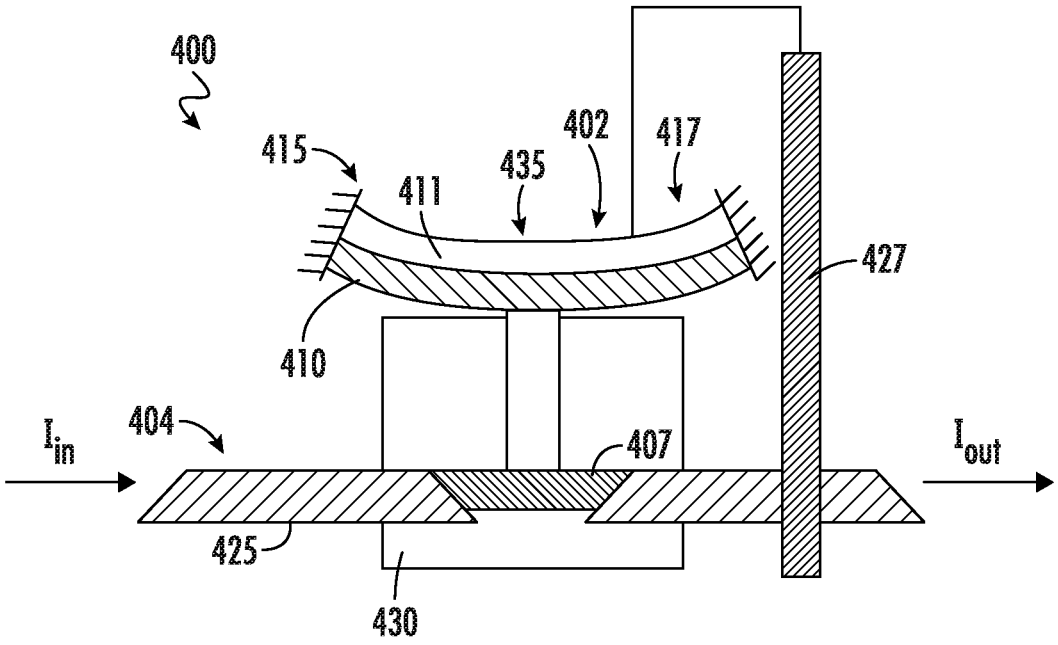
FIG. 4B is a side view of the MEMS switch assembly of FIG. 4A in a closed configuration according to exemplary embodiments of the disclosure.

Turning now to FIGS. 4A-4B, a MEMS switch assembly (hereinafter "assembly") 400 according to embodiments of the disclosure will be described. As shown, the assembly 400 may include a first contact element 402 operable with a second contact element 404 to form an open or closed circuit. In some embodiments, the second contact element 404 is part of a first electrical load line 425, which receives a current L. The first contact element 402 may be electrically connected to a second load line 427. In exemplary embodiments, the first and second contact elements 402, 404 are each electrically conductive, wherein the first contact element 402 includes a contact tip 407. As shown, the contact tip 407 and the second contact element 404 may have complementing geometries to enable an electrical connection therebetween. However, the generally trapezoidal plan view shape of the contact tip 407 is shown by way of example only, and one of ordinary skill in the art will appreciate that many alternative geometries and configurations for making/breaking contact are possible within the scope of the present disclosure. As shown, a first end 415 and a second end 417 of the first contact element 402 are each fixed.

In some embodiments, the first contact element 402 may include a magnetostrictive element 410 coupled to a bi-metallic strip 411. For example, as shown, the magnetostrictive element 410 and the bi-metallic strip 411 may be directly physically coupled to one another. In other embodiments, the first contact element 402 may be made partially or entirely from a magnetostrictive material. The bi-metallic strip 411 may be a spring-like element providing the necessary robustness and elasticity for making/breaking contact between the first and second contact elements 402, 404. The bi-metallic strip 411 may be a metallic material, a polyimide material, a nitride material, or any other suitable flexible material. As further shown, the assembly 400 may include a microelectronic substrate 430, which may be formed of silicon or any other similar microelectronic substrate material.

In various embodiments, the first and second load lines 425, 427 may comprise copper, gold, aluminum, polysilicon or another suitable electrically conductive material. The first contact element 402 is capable, upon actuation, of switching electrical current between the first and second load lines 425, 427. In operation, when a magnetic flux is applied across a magnetic flux path, the first contact element 402 is actuated in a pre-determined direction. FIG. 4A demonstrates the assembly 400 in a first configuration (e.g., open), while FIG. 4B demonstrates the assembly 400 in a second configuration (e.g., closed). In exemplary embodiments, the presence of a magnetic field causes the magnetostrictive element 410 to change shape (e.g., elongate/expand), thus causing the first contact element 402 to change from a generally concave shape to a generally convex shape. This change in configuration/shape causes the contact tip 407 to move towards and electrically contact the second contact element 404. More specifically, a central portion 435 of the first contact element 402 may extend away from the second contact element 404 in the first configuration, and extend towards the second contact element 404 in the second configuration. In non-limiting embodiments, the assembly 400 is normally open. In other embodiments, the assembly 400 may be normally closed, and opens in response to the magnet proximate thereto.

The assembly 400 may be formed using MEMS fabrication methods. For example, in one non-limiting embodiment, a microelectronic substrate has a thin dielectric layer disposed thereon. The microelectronic substrate may comprise silicon, quartz, aluminum, glass or any other suitable microelectronic substrate material. It is also possible to use a magnetic material for the substrate, such as ferrite nickel, if a non-magnetic dielectric layer is disposed on the substrate. The dielectric layer may comprise silicon nitride, silicon oxide or any other suitable dielectric material. The dielectric layer is typically disposed on the substrate via the use of conventional chemical vapor deposition (CVD) techniques. The dielectric layer serves to isolate the electrical load line conductor metals from the substrate. The second electrical load line may be disposed on the substrate by standard patterning and etch procedures. The second electrical load line may comprise any conductive material, such as doped-silicon, copper, aluminum or the like. The first electrical load line may be disposed on the substrate, wherein the first electrical load line includes any conductive material, such as copper, nickel, aluminum or the like. In some embodiments, the first electrical load line may be overplated with a thin layer of metallic material, such as gold or the like, to insure low electrical resistance at the point of contact.

In sum, embodiments herein provide a magnetostrictive material operable to bias a first contact element and a second contact element relative to one another to form an open or closed circuit. The circuit assemblies and methods described herein advantageously provide a simplified switch, with less components and therefore lower cost.

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

What is claimed is:

1. A switch assembly comprising:

a first contact element operable with a second contact element to form an open circuit or a closed circuit, at least one of the first contact element and the second contact element including a magnetostrictive element coupled to a bi-metallic strip, the magnetostrictive element operable to bias the first contact element and the second contact element relative to one another to form the open circuit or the closed circuit, wherein the bi-metallic strip comprises a first strip formed of a first metal having a first coefficient of thermal expansion and a second strip coupled to the first strip and formed of a second metal having a second coefficient of thermal expansion different from the first coefficient of thermal expansion.

2. The switch assembly of claim 1, further comprising a magnet proximate the first and second contact elements, wherein a magnetic field of the magnet causes the magnetostrictive element to change shape.

3. The switch assembly of claim 2, wherein movement of the magnet relative to the first and second contact elements causes the first and second contact elements to change between the first configuration and the second configuration.

4. The switch assembly of claim 1, wherein the magnetostrictive element is directly physically coupled to the first contact element or the second contact element.

5. The switch assembly of claim 1, wherein at least one of the first contact element and the second contact element have a curved shape.

6. The switch assembly of claim 1, wherein the first contact element curves away from the second contact element in a first configuration, and wherein the first contact element curves towards the second contact element in a second configuration.

7. The switch assembly of claim 1, further comprising a switch circuit receiving an indication of the open circuit or the closed circuit.

8. A switching method comprising:

providing a first contact element operable with a second contact element, wherein the first and second contact member form an open circuit in a first configuration and form a closed circuit in a second configuration, and wherein at least one of the first contact element and the second contact element includes a magnetostrictive element coupled to a bi-metallic strip, wherein the bi-metallic strip comprises a first strip formed of a first metal having a first coefficient of thermal expansion and a second strip coupled to the first strip and formed of a second metal having a second coefficient of thermal expansion different from the first coefficient of thermal expansion; and biasing the first contact element and the second contact element relative to one another using a magnetic field to change the shape the magnetostrictive element.

9. The switching method of claim 8, further comprising changing the shape of the magnetostrictive element to form the open circuit and the closed circuit.

10. The switching method of claim 8, further comprising providing a magnet proximate the first and second contact elements.

11. The switching method of claim 10, further comprising causing the first and second contact elements to change between the first configuration and the second configuration in response to movement of the magnet relative to the first and second contact elements.

12. The switching method of claim 8, further comprising directly physically coupling the magnetostrictive element to the first contact element or the second contact element.

13. The switching method of claim 8, wherein at least one of the first contact element and the second contact element have a curved shape.

14. The switching method of claim 8, wherein the first contact element curves away from the second contact element in the first configuration, and wherein the first contact element curves towards the second contact element in the second configuration.

15. The switching method of claim 8, further comprising providing an indication of the open circuit or the closed circuit.

* * * * *